United States Patent [19]

Bennett

[11] 4,139,400

[45] Feb. 13, 1979

[54] SUPERPLASTIC ALUMINIUM BASE ALLOYS

[75] Inventor: Clive G. Bennett, Georgetown, Australia

[73] Assignee: Comalco Aluminium (Bell Bay) Limited, Tasmania, Australia

[21] Appl. No.: 589,707

[22] Filed: Jun. 23, 1975

[30] Foreign Application Priority Data

Jun. 27, 1974 [AU] Australia ..... 7997/74

[51] Int. Cl.[2] ..... C22C 21/00

[52] U.S. Cl. ..... 148/32; 75/138; 75/139; 75/142; 75/143; 75/147; 75/148

[58] Field of Search ..... 75/138, 139, 142, 143, 75/147, 148, 135; 148/32, 32.5

[56] References Cited

U.S. PATENT DOCUMENTS

| | | | |
|---|---|---|---|
| 1,945,297 | 1/1934 | Sterner-Rainer | 75/147 |
| 3,124,452 | 3/1964 | Kraft | 75/135 |
| 3,727,524 | 4/1973 | Nishiyama et al. | 75/148 |
| 4,002,502 | 1/1977 | Bainbridge et al. | 75/138 |
| 4,068,645 | 1/1978 | Jenkinson | 75/148 |

*Primary Examiner*—R. Dean

*Attorney, Agent, or Firm*—Burns, Doane, Swecker & Mathis

[57] ABSTRACT

Aluminium base alloys exhibiting superplastic deformation characteristics at elevated temperatures, having fully modified eutectic microstructures characterized by the absence of any primary phase and by the presence of at least one finely dispersed eutectic second phase.

6 Claims, No Drawings

SUPERPLASTIC ALUMINIUM BASE ALLOYS

This invention relates to aluminium base alloys which are made to exhibit superplastic deformation characteristics at elevated temperatures and are thus rendered capable of being shaped superplastically from either cast or wrought stock.

Superplasticity in metals and alloys denotes an ability to accommodate large amounts of plastic deformation without failure under the influence of low forming stresses.

Alloys suitable for superplastic forming usually possess an ultrafine grain size of 10 microns or less and a capability to retain this fine grain size at elevated temperatures for such periods as are necessary in forming operations. In addition, such alloys have indices of strainrate sensitivity in excess of 0.3 and undergo high "neck-free" tensile elongations at elevated temperatures.

In general, known superplastic alloys are "duplex" i.e. two-phase alloys in which the ultrafine grain size has been obtained by intensive and costly thermo-mechanical treatments of an as-cast material which, of itself, does not possess the desired microstructural features. Other known superplastic alloys are substantially single phase alloys in which a fine grained equiaxed microstructure has been stabilized by minor quantities of recrystallisation inhibitors forming extremely fine grain boundary precipitates. The production of such a microstructure necessitates extensive thermo-mechanical treatments of the 'as-cast' materials. One known superplastic aluminium alloy of Al - 6.0 wt % Cu - 0.4 wt % Zr composition requires extensive hot rolling and thermal treatments between 300° C and 500° C to develop optimum superplastic response.

A principal aspect of the present invention is the production of an ultrafine fully modified eutectic microstructure comprising at least one eutectic phase suitable for superplastic forming by effecting the solidification of substantially eutectic or hyper-eutectic binary and ternary aluminium alloys under particular conditions of controlled growth rate (R) and temperature gradient (G). In this way, ultrafine fully modified eutectic microstructures are produced from which any primary phase has been purposely excluded. By fully modified is meant a eutectic formed by coupled growth of the relevant constituent phases. The size of the particles of the finely dispersed second or eutectic phase is less than 10 microns, preferably less than 1 micron.

In other words, by appropriate choice of alloy composition and casting conditions, metastable eutectic structures can be formed in certain aluminium-base alloys at solute concentrations different from the equilibrium eutectic composition. By control of the solidification conditions, the formation of undesirable primary phases is prevented. In their place small fully modified substantially fibrous particles of a dispersed eutectic phase are produced thereby giving rise to unique microstructures which are characterized by finely dispersed second phase in the absence of any primary phase.

Certain binary alloys of the Al-Si, Al-Fe, Al-Mn systems, both with or without additions of other well known alloying elements for age and/or dispersion hardening, can be successfully produced in this fully modified form. Certain ternary alloys of the Al-Fe-Mn and Al-Fe-Cu systems can also be so produced.

By way of example the chemical compositions of some suitable alloys are shown below:

| 1. Al-Si Alloys | | |
|---|---|---|
| Element | % | |
| Si | 11 - 20 | |
| Mg | 0 - 4 | for age/dispersion hardening, if desired |
| Cu | 0 - 4 | |
| Sr | 0 - 0.1 | |
| Na | 0 - 0.1 | |
| Al | Remainder, apart from impurities. | |

Strontium and/or sodium are the preferred elements for modification of the microstructure, but other alkali or alkaline earth metals may also be suitable for this purpose. The addition of such elements may not be necessary if the desired fully modified microstructure is obtained by the control of solidification conditions as mentioned.

| 2. Al-Fe Alloys | | |
|---|---|---|
| Elements | % | |
| Fe | 2 - 5 | |
| Mn | 0 - 2 | for age/dispersion hardening, if desired |
| Cu | 0 - 2 | |
| Li | 0 - 0.1 | |
| Al | Remainder, apart from impurities. | |

Lithium is the preferred element for modification of the microstructure but other alkali or alkaline earth metals may also be suitable for this purpose.

| 3. Al-Mn Alloys | | |
|---|---|---|
| Element | % | |
| Mn | 2 - 6 | |
| Si | 0 - 1 | |
| Cu | 0 - 2 | for age/dispersion hardening, if desired |
| Fe | 0 - 3 | |
| Mg | 0 - 4 | |
| Al | Remainder, apart from impurities | |

Alkali or alkaline earth metals may be used for modification of the microstructure.

| 4. Al-Fe-Mn Alloys | |
|---|---|
| Elements | % |
| Fe | 1 - 4 |
| Mn | 2 - 5 |
| Si | 0 - 1 |
| Al | Remainder, apart from impurities |

| 5. Al-Fe-Cu Alloys | |
|---|---|
| Elements | % |
| Fe | 1 - 3 |
| Cu | 1 - 4 |
| Al | Remainder, except for impurities |

For alloys in groups 4 and 5 alkali or alkaline earth metals may be used for modification of the microstructure.

Another aspect of the invention is that no intensive and costly thermo-mechanical treatments are required to produce the microstructure necessary for superplastic forming. Except for the special conditions of controlled composition and solidification, processing is of a conventional nature, e.g. heat treatment, rolling forging or extrusion. Although these treatments are primarily designed to obtain the alloy stock in a suitable form for subsequent deformation, they also enhance super-plastic behaviour under the appropriate conditions of temperature and strain rate.

A further feature of the invention is the inherent thermal stability of the two-phase microstructure at temperatures used in superplastic forming owing to the presence of a high volume fraction of a dispersed second phase which restricts the recrystallization, grain growth and/or polygonisation of the continuous aluminium phase of the eutectic. The coarsening of the dispersed phase(s) by diffusional processes is so slow that the two-phase structure remains stable and maintains its fine particle size for the duration of the preheating and forming cycles.

The microstructures of the Al-Si alloys are characterized by a high volume fraction of dispersed eutectic silicon and no primary silicon idiomorphs or primary aluminium.

The microstructures of the Al-Fe alloys are characterized by a high volume fraction of dispersed eutectic $FeAl_6$ and an absence of angular or needle-like primary $FeAl_3$ or primary aluminium.

The microstructures of the Al-Mn alloys are characterized by a high volume fraction of dispersed $MnAl_6$ and an absence of primary $MnAl_6$ or primary aluminium.

In the ternary alloys, in the presence of appreciable manganese and copper contents, the dispersed eutectic will be $(Mn,Fe)Al_6$ or $(Fe,Cu)Al_6$, both phases being formed by substitution of Fe by Mn or Cu in the phase $FeAl_6$. These complex phases are iso-structural with $FeAl_6$. In the presence of appreciable iron contents in Al-Mn-Fe, the dispersed eutectic will be (Mn, Fe) $Al_6$. This complex phase is iso-structural with $MnAl_6$.

The desired microstructures in all the alloys are produced essentially by careful selection of the right combination of four parameters, namely, solute element content, modifier content (if necessary), growth rate (R) and temperature gradient (G) during solidification.

The general limits for growth rate (R) and temperature gradient (G) are of the order 10-5000 microns/-second and 1°-500° C/cm respectively. The preferred ranges for the various alloy groups 1 - 5 are shown below.

| | Alloy System | Growth Rate (R) Microns/Second | Temperature Gradient (G) ° C/cm |
|---|---|---|---|
| 1. | Al-Si | 200 - 500 | 10 - 200 |
| 2. | Al-Fe | 500 - 1000 | 100 - 200 |
| 3. | Al-Mn | 1000 - 2000 | 100 - 250 |
| 4. | Al-Fe-Mn | 1000 - 2000 | 100 - 250 |
| 5. | Al-Fe-Cu | 500 - 1000 | 100 - 200 |

It is noteworthy that alloys possessing the high volume fraction of finely dispersed second phase(s) in their microstructures which is essential to superplastic forming behaviour, also exhibit greatly improved ductility or "extended plasticity" at room temperature. Higher than usual ductility at room temperature is also observed in these alloys if they contain some primary aluminium dendrites, but such ductility improvements tend to diminish as the amount of primary phase increases.

Three typical illustrative examples for alloys in groups 1, 2 and 3 will now be given:

EXAMPLE 1

A typical alloy of group (1) according to the invention was unidirectionally solidified from a composition of 13.3% Si, 0.02% Sr at a growth rate, R = 200 microns/Sec. and temperature gradient at the solid/liquid interface, G = 25° C/cm.

The alloy was then heated at 540° C for 15 hours and cold rolled to 83% reduction prior to being high temperature tensile tested to evaluate its superplastic characteristics. This type of treatment approximates that used in standard production of sheet material; whilst desirable the treatment is not essential for successful superplastic forming in accordance with this invention.

The results of high temperature tensile tests at 550° C over the range of strain rates $10^{-3}$ to 1 $min^{-1}$ have shown a strain rate sensitivity index 'm' of 0.41 and an elongation of 330%.

EXAMPLE 2

A typical alloy of group 2 according to the invention was unidirectionally solidified from a composition of 2.62% Fe, at a growth rate R = 700 microns/sec and temperature gradient at the solid/liquid interface, G = 100° C/cm.

Approximating production conditions for sheet material of this type the alloy was heated at 540° for 15 hours, cold rolled to a reduction of 30%, then annealed for a further 2 hours and cold rolled to 82% reduction before being high temperature tensile tested. As in the case of example 1, this type of processing is not absolutely essential.

The results of high temperature tensile tests at 620° C over the range of strain rates $10^{-3}$ to 1 $min^{-1}$ have shown a strain rate sensitivity index 'm' of 0.53 and an elongation of 220%.

EXAMPLE 3

A typical alloy according to the invention was unidirectionally solidified from a composition of 3.6% Mn, 0.11% Fe, 0.10% Si, at a growth rate R = 1000 microns/s and a temperature gradient at the solid/liquid interface, G = 100° C/cm.

In a similar way to that described in Examples 1 & 2 the alloy was heated at 600° for 16 hours and then cold rolled to a reduction of 85% before being high temperature tensile tested. The results of high temperature tensile tests at 620° C over the range of strain-rates $10^{-3}$ to 1 $min^{-1}$ have shown a strain-rate sensitivity index "m" of 0.32.

I claim:

1. A process for preparing an aluminum base alloy having an ultra fine fully modified eutectic microstructure which comprises forming a liquid melt of composition as hereinafter set forth, and allowing said melt to solidify under controlled conditions such that the rate of growth of the solid phase during solidification is 1000 - 2000 microns/sec and the temperature gradient of the solid/liquid interface is from 100° - 250° C/cm, thereby to produce an alloy characterized by the absence of any primary phase and the presence of a high volume fraction of dispersed eutectic phase in the form of fibrous fully modified particles of size less than 10 microns; said composition being:

| Element | % |
|---|---|
| Mn | 2 - 6 |
| Si | 0 - 1 |
| Cu | 0 - 2 |
| Fe | 0 - 3 |
| Mg | 0 - 4 |

-continued

| Element | % |
|---|---|
| Al | Remainder, apart from impurities. |

2. A process for preparing an aluminum base alloy having an ultra fine fully modified eutectic microstructure which comprises forming a liquid melt of composition as hereinafter set forth, and allowing said melt to solidify under controlled conditions such that the rate of growth of the solid phase during solidification is 1000 - 2000 microns/sec and the temperature gradient of the solid/liquid interface is from 100° - 250° C/cm, thereby to produce an alloy characterized by the absence of any primary phase and the presence of a high volume fraction of dispersed eutectic phase in the form of fibrous fully modified particles of size less than 10 microns; said composition being:

| Element | % |
|---|---|
| Fe | 1 - 4 |
| Mn | 2 - 5 |
| Si | 0 - 1 |
| Al | Remainder, apart from impurities. |

3. A process for preparing an aluminum base alloy having an ultra fine fully modified eutectic microstructure which comprises forming a liquid melt of composition as hereinafter set forth, and allowing said melt to solidify under controlled conditions such that the rate of growth of the solid phase during solidification is 500 - 1000 microns/sec and the temperature gradient of the solid/liquid interface is from 100° - 200° C/cm, thereby to produce an alloy characterized by the absence of any primary phase and the presence of a high volume fraction of dispersed eutectic phase in the form of fibrous fully modified particles of size less than 10 microns, said composition being:

| Element | % |
|---|---|
| Fe | 1 - 3 |
| Cu | 1 - 4 |
| Al | Remainder, except for impurities. |

4. Aluminum-manganese alloys prepared by the process of claim 1.

5. Aluminum-iron-manganese alloys prepared by the process of claim 2.

6. Aluminum-iron-copper alloys prepared by the process of claim 3.

* * * * *